US005844797A

United States Patent [19]

Johnson

[11] Patent Number: 5,844,797

[45] Date of Patent: Dec. 1, 1998

[54] PHOTOGRAPHIC ALBUMS

[75] Inventor: William Nevill Heaton Johnson, Guernsey, Channel Islands

[73] Assignee: Durand Limited, Channel Islands

[21] Appl. No.: 750,935

[22] PCT Filed: Aug. 18, 1995

[86] PCT No.: PCT/GB95/01970

§ 371 Date: Apr. 7, 1997

§ 102(e) Date: Apr. 7, 1997

[87] PCT Pub. No.: WO96/06743

PCT Pub. Date: Mar. 7, 1996

[30] Foreign Application Priority Data

| | | | |
|---|---|---|---|
| Aug. 26, 1994 | [GB] | United Kingdom | 9417342 |
| Sep. 20, 1994 | [GB] | United Kingdom | 9418897 |
| Apr. 6, 1995 | [GB] | United Kingdom | 9507092 |

[51] Int. Cl.[6] ..... B42F 5/00

[52] U.S. Cl. ..... 364/400; 396/311; 396/310

[58] Field of Search ..... 364/525, 400; 283/56, 33; 206/232; 446/147; 40/726, 700, 725, 361; 358/453, 450, 452; 396/6, 207, 208, 210, 297, 310, 311

[56] References Cited

U.S. PATENT DOCUMENTS

| | | | |
|---|---|---|---|
| 5,029,902 | 7/1991 | Komori | 283/56 |
| 5,180,906 | 1/1993 | Yamada . | |
| 5,229,585 | 7/1993 | Lemberger et al. . | |
| 5,330,281 | 7/1994 | Kalan | 402/73 |
| 5,563,722 | 10/1996 | Norris | 358/453 |

FOREIGN PATENT DOCUMENTS

| | | |
|---|---|---|
| A-1067849 | 6/1954 | France . |

*Primary Examiner*—Melanie Kemper
*Attorney, Agent, or Firm*—Arnold B. Silverman; Michael D. Lazzara; Eckert Seamans Cherin & Mellott, LLC

[57] ABSTRACT

A photographic album is proposed for a selected theme which has pre-printed pictures or views, with accompanying text, to provide the user with guidance and inspiration to take a corresponding series of photographs on the same theme. The photographs taken are then processed and substituted for the corresponding pre-printed views, either in the same album or in a reproduction of the album so that the customer then has a structured album of photographs with appropriate accompanying text.

1 Claim, No Drawings

PHOTOGRAPHIC ALBUMS

THIS INVENTION relates to photographic albums and it is an object of the invention to provide a photographic album particularly adapted to provide a personalised or enhanced record of an individual's visit to a geographic location, building or the like.

According to one aspect of the invention there is provided a photograph album with spaces for pictures or views specified in the album and which pictures or views are to be photographically recorded by the user for application to said spaces.

In one embodiment, the album is in the form of a guidebook appropriate to a geographic location, historic building or the like, with spaces to receive photographs of specified parts of the location, building or the like. The user of the album may thus follow the guidebook and take personalised photographs of the parts of the location indicated to fit in the spaces provided so that the completed album will provide a personalised yet organised record of the visit to the location or building concerned (personalised, for example, in that friends or relatives may be included in the respective photograph). At the same time, the completed guidebook will provide additional interest for third parties viewing the album in the way that a disorganised collection of individual photographs will not.

According to another aspect of the invention there is provided the combination of a photographic album and guide book as disclosed above with an inexpensive or disposable camera and photographic film. Such a combination may be sold in the form of a pack, for example, contained in a cardboard box or encapsulated in transparent plastics shrink film.

It is envisaged that such guidebooks, or the packs including such guidebooks, would be sold at gift shops or the like in the vicinity of the location or building to which they appertain, for purchase by visitors to that location or building. Alternatively, such albums or packs may be supplied by mail order, so that customers could order the album or pack relating to an area or building which they intended to visit, in advance of such visit.

It is further envisaged that an index of the various categories of such photograph album/guide books or combination packs available would be displayed at sales outlets for photographic film and materials and at establishments accepting photographic film for processing so that customers might be encouraged to acquire such albums and to take photographs, for insertion in such albums, which they would not otherwise have taken. Likewise mail order film processors might, in sending out to customers prints made from customers' films, enclose free catalogues or indices of such album/guide books or combination packs available from the processors, as a means of promoting sales of photographic film and utilisation of the processors' services.

In a further development of the invention, the camera/film combination incorporates a coding arrangement whereby a particular code marking is applied to the film, for each frame exposed, and the camera includes means for providing to the user or means whereby the user can provide to the camera, an indication of the corresponding code, corresponding in turn to a respective code marking assigned to the respective space in the album, the film processing apparatus being controlled by program means so as to produce, for each frame of film exposed, a respective print of the size appropriate for the corresponding space allocated in the album, the apparatus being arranged to vary the size of print produced according to such program.

Thus, in such arrangement, the album may have relatively large areas provided for, for example, photographs of notable views or buildings and may have relatively smaller areas reserved for individual features or details of interest, for example particular statues. The simplest coding arrangement envisaged might simply utilise the frame marking conventionally provided on photographic film, the disposable camera ideally being pre-loaded with such film so as to ensure that the first frame exposed coincides exactly with the first frame number, the second frame exposed with the second frame number and so on, and with the camera having a corresponding frame counter to indicate to the user the frame number next to be exposed, and with the respective spaces reserved in the photographic album having corresponding numbers marked therein. Such an arrangement, however, would require the respective views to be photographed in a predetermined sequence and accordingly it is envisaged that the camera may incorporate a control operable by the user and which would apply to the film a code marking determined by such control, in accordance with the space in the album which the user next intended to fill. Such an arrangement might incorporate magnetic coding means cooperating with a magnetic stripe provided along the film or might cause a respective optical code marking to be applied photographically to the part of the film bounding the normally exposed area. The film processing apparatus, in either arrangement, is adapted to read the code marking on the film and is automatically controlled, for example by computer, to produce, for each view, a respective print of a size assigned to that particular code marking in memory means in the apparatus, for example in computer memory, whereby the processing apparatus will provide, for successive frames, successive prints of different sizes predetermined by the program and appropriate to fill the respective spaces in the album.

It will be appreciated that whilst, in the above description, the album has been described as a guidebook to a geographical location, historical site, building or the like, many variations are possible within the scope of the invention. For example, an album for use by bird-watchers or naturalists might incorporate respective spaces designated for photographs of animals or birds of particular species. Analogous albums may be provided for special, e.g. domestic, occasions such as weddings, birthday parties, christenings, various anniversaries, etc. or in relation to particular excursions, for example, albums relating to theme parks, amusement parks, zoos or the like or may be supplied in conjunction with pre-selected cruises, safaris or the like.

In a variant, the album as originally sold may comprise a plurality of pages detachably secured in a binder, for example in the form of a lace binder or ring binder, the pages bearing, as before, pictures of the features to be photographed, with associated descriptive and background text. However, in this variant, instead of the photographs taken by the customer being eventually secured to the pages of the guide book, in the appropriate areas reserved for these, the arrangement is such that the customer, after he has taken photographs of all of the features specified in the album, sends the film, with the disposable camera and the album, to the processor and the latter produces replacement pages for the album, each page being in the form of a photographic print including the respective scenes or subjects specified on the corresponding original page but photographed by the customer and further including, e.g. photographically reproduced, the appropriate textual material, etc. The processor, in this variant, replaces the original pages in the binder with the replacement pages and returns the binder to the customer. Clearly, in such a system, it may be more cost effective to avoid the necessity for sending the album back and forth by simply arranging for the guide book originally sold to customers to have an identifying page or coupon which can be detached and sent to the processor with the film and disposable camera and for the processor to prepare an album to be sent to the customer, incorporating the photographically printed "replacement" pages bearing the customers photographs.

In a further variant or variants the customer may first send to the processor the film to be processed, but may retain the originally purchased album until he receives the processed prints. The customer may then attach the prints according to his wishes in the album and mark any changes he wishes to be made (as described further below). The customer may also indicate what text he wishes to place beside which views, the manner in which he wishes that text to be arranged, the size and style of the print, and so on. The customer may thus insert text or captions of his own choosing to be printed in a desired font on the final product. Thus, for example, predefined captions in the first-order album may be altered, deleted, augmented or replaced by text provided by the customer. The customer may then send that album, (herein referred to for convenience as the first order album) back to the processor for the production of a finished album (herein also referred to as a second order album).

The finished album may be prepared by computer-controlled colour printer or analogous computer-controlled process. This process may, for example, include scanning the photographs supplied by the customer (or the corresponding processed photographic film, negative or positive) by means of a colour scanner, known per se, converting the resulting signals into digital form and processing the resulting digital signals or digital record by computer, the computer producing signals (or a digital record from which signals can be generated) for controlling a colour printer or analogous device.

This computer-based procedure preferably allows photographic images supplied by the customer to be manipulated as desired, for example, enlarged or reduced or modified by changing colours or colour balances or removing particular features or adding features or mixing features from two or more photographs, so that, for example, "red-eye" in photographs taken by flash may be eliminated or a feature such as a tree or a lamp-post which appears to sprout from the subject's head in a photograph may be eliminated, or an image of a person (for example the photographer) originally missing from a particular view may be introduced into that view, or a historic building or particular scenic view, for example, may be substituted, as the background to a group portrait, for a nondescript background present in the original photograph. Likewise, the image of a particular person may be deleted from a photograph, or replaced by an image of another person, and so on. The required text is preferably also inserted, in the desired locations and in the desired size, and font, etc. by the computer/printer combination at this stage. Thus, after a customer has taken his photographs and has had the resulting film processed, he may, at that stage, decide what modifications he requires, what text is to be changed or inserted, and so on, and may return the original album, with the photographs and an indication of the modifications, insertions, etc. he requires, to the processing station for computer-based further processing in the manner described. To assist this process, the first-order album may include a table of special effects and procedures etc. available, using the computer-based service, with simple instructions as to how to represent the desired procedures or effects in some computer-readable form. For example, a chart may be provided comprising various spaces into selected ones of which the customer may insert, for example by pen, crosses or other markings, such charts being computer-readable at the processing station to determine which procedures and actions are required. It is possible that some measure of human supervision may be required at the processing station, depending upon the complexity and nature of the effects desired. The finished or second-order album, prepared by computer-controlled colour printer or analogous device, will then be sent to the customer.

It is envisaged that the customer will be able to order as many copies of the second-order album as he pleases, for example for distribution to friends, or to guests at the social occasion concerned, and so on.

Since the production of the second-order album is computer-based, the second-order albums may be stored in digital form, for example on floppy disk, allowing further copies of such a second-order album to be produced without defect when desired.

It will be understood that the last noted variant lends itself to photographs using digital recording upon magnetic media (such as miniature floppy disks) instead of using conventional silver halide photographic materials. Various proposals for such photographic systems are already in the public domain. Indeed as the nature of the photographic system employed is not the essence of the present invention, it will be understood that any of the embodiments described above may utilise photographic systems using digital (or analog) recording upon magnetic media (e.g. floppy disks or video tape), instead of systems using conventional silver halide materials. The references in the specification and claims to photography are accordingly intended to extend to recordal of images in ways other than using silver halide materials, and in particular to recordal of images upon magnetic media. Of course, in the case where, in said last-noted variant, the photographic system used records the image information digitally on a magnetic medium, the customer would merely send the digital recording medium e.g. floppy disks, to the processor and the data thereon would be read directly into the computer, (that is to say the need for scanning of photographs, as such, would be eliminated). It will also be understood that, in principle, frames from video cassette recordings made by customers using camcorders, for instance, could be similarly processed (the scanning step being replaced, in this case, by passing the respective signals from playback of the recording to an appropriate digitiser for video signals).

It will also be appreciated that, in said last-noted variant, there is no technical necessity for the first-order album to be standardised so that a customer might, if he wished, use an album from some other source, or assembled himself as the first-order album, and might determine the form and content of the second-order album himself, without constraint, providing all of his own "artwork", with any deficiencies in the first-order album being corrected, preferably automatically by the processor. However, it is believed that many customers will find the measure of discipline imposed by a predefined first-order album rather helpful.

I claim:

1. Film processing apparatus adapted for use in conjunction with a combination of a photograph album with spaces for pictures or views specified in the album and which pictures or views are to be photographically recorded by the user for application to said spaces, with a camera and photographic film therefor and wherein the camera/film combination incorporates a coding arrangement whereby a particular code marking is applied to the film, for each frame exposed, and the camera includes means for providing to the user, or means whereby the user can provide to the camera, an indication of a corresponding code, corresponding in turn to a respective code marking assigned to the respective space in the album, the film processing apparatus being controlled by program means so as to produce for each frame of film exposed a respective print of the size appropriate for the corresponding space allocated in the album and to vary the size of print produced according to such program.

* * * * *